US010278894B1

(12) United States Patent
Le et al.

(10) Patent No.: US 10,278,894 B1
(45) Date of Patent: May 7, 2019

(54) JET ASSEMBLY HAVING A FRICTION-REDUCING MEMBER

(71) Applicants: Kevin Le, Richland Hills, TX (US); Thanh Le, Grand Prairie, TX (US)

(72) Inventors: Kevin Le, Richland Hills, TX (US); Thanh Le, Grand Prairie, TX (US)

(73) Assignee: Luraco, Inc., Arlington, TX (US)

( * ) Notice: Subject to any disclaimer, the term of this patent is extended or adjusted under 35 U.S.C. 154(b) by 0 days.

(21) Appl. No.: 15/889,154

(22) Filed: Feb. 5, 2018

(51) Int. Cl.
*A61H 33/00* (2006.01)

(52) U.S. Cl.
CPC ..... *A61H 33/6047* (2013.01); *A61H 33/6042* (2013.01); *A61H 2201/1215* (2013.01)

(58) Field of Classification Search
CPC ..... A61H 2201/1215
USPC ..... 417/420; 4/615, 601
See application file for complete search history.

(56) References Cited

U.S. PATENT DOCUMENTS

| | | | |
|---|---|---|---|
| 2,506,886 | A | 5/1950 | Okulitch et al. |
| 2,545,422 | A | 3/1951 | Blom |
| 2,951,689 | A | 9/1960 | Asp et al. |
| 2,958,517 | A | 11/1960 | Harker et al. |
| 3,089,514 | A | 5/1963 | Sudmeier |
| 3,198,125 | A | 8/1965 | Yuza et al. |
| 3,299,819 | A | 1/1967 | McCoy |
| 3,411,450 | A | 11/1968 | Clifton |
| 3,572,651 | A | 3/1971 | Harker |
| 3,630,645 | A | 12/1971 | Eheim |
| 3,932,068 | A | 1/1976 | Zimmermann |
| 3,941,517 | A | 3/1976 | Miyahara |
| 4,082,380 | A | 4/1978 | Klaus et al. |

(Continued)

FOREIGN PATENT DOCUMENTS

| | | | |
|---|---|---|---|
| CA | 1286755 | C | 7/1991 |
| CN | 203396450 | U | 1/2014 |

(Continued)

OTHER PUBLICATIONS

ANS Gspa F Pedicure Spa (http://buynailsdirect.com/nails-salon-pedicure-spas/glass-sink-spas/ans-gspa-f-pedicure-spa.html), Aug. 15, 2016.

(Continued)

*Primary Examiner* — Janie M Loeppke
(74) *Attorney, Agent, or Firm* — Hoang Steve Ngo

(57) ABSTRACT

The present invention is directed to a jet assembly comprising a jet assembly housing, a magnetic impeller, and at least one friction-reducing member. The present invention is also directed to a fluid pump that comprises a motor assembly and a jet assembly comprising a jet assembly housing, a magnetic impeller, and at least one friction-reducing member. The present invention is further directed to a method for dispensing a fluid using the jet assembly comprising a jet assembly housing, a magnetic impeller, and at least one friction-reducing member. The at least one friction-reducing member allows a motor assembly to cause a magnetic impeller to rotate within a jet assembly housing and preferably not make contact with an inner surface of a back cover of the jet assembly housing during operation of the jet assembly such that a shaft member(s) and/or a bearing(s) is/are not required for rotation of the magnetic impeller.

30 Claims, 18 Drawing Sheets

(56) References Cited

U.S. PATENT DOCUMENTS

| | | | | |
|---|---|---|---|---|
| 4,115,040 | A | 9/1978 | Knorr | |
| 4,135,863 | A | 1/1979 | Davis et al. | |
| 4,226,574 | A | 10/1980 | Villette | |
| 4,304,532 | A | 12/1981 | McCoy | |
| 4,312,752 | A | 1/1982 | Malik | |
| 4,331,496 | A | 5/1982 | Orndorff, Jr. et al. | |
| 4,513,735 | A | 4/1985 | Friedson et al. | |
| 4,523,580 | A | 6/1985 | Tureaud | |
| 4,569,337 | A | 2/1986 | Baumann et al. | |
| 4,606,698 | A | 8/1986 | Clausen et al. | |
| 4,716,605 | A | 1/1988 | Shepherd et al. | |
| 4,875,497 | A | 10/1989 | Worthington | |
| 4,982,606 | A | 1/1991 | Adamski et al. | |
| 5,145,323 | A | 9/1992 | Farr | |
| 5,238,369 | A | 8/1993 | Farr | |
| 5,245,221 | A | 9/1993 | Schmidt et al. | |
| 5,414,878 | A | 5/1995 | Booth | |
| 5,458,459 | A | 10/1995 | Hubbard et al. | |
| 5,587,023 | A | 12/1996 | Booth | |
| 5,980,112 | A | 11/1999 | Matthews | |
| 5,992,447 | A | 11/1999 | Miller et al. | |
| 6,732,387 | B1 | 5/2004 | Waldron | |
| 6,997,688 | B1 | 2/2006 | Klein et al. | |
| 7,108,202 | B1 | 9/2006 | Chang | |
| 7,111,334 | B2 | 9/2006 | Chen | |
| 7,168,107 | B2 | 1/2007 | Gruenwald | |
| 7,393,188 | B2 | 7/2008 | Lawyer et al. | |
| 7,432,725 | B2 | 10/2008 | Sieh et al. | |
| 7,440,820 | B2 | 10/2008 | Gougerot et al. | |
| 7,572,115 | B2 * | 8/2009 | Klein | F04D 29/026 310/103 |
| 7,574,756 | B2 | 8/2009 | Tran | |
| 7,593,789 | B2 | 9/2009 | Gougerot et al. | |
| 8,214,937 | B2 | 7/2012 | Lawyer et al. | |
| 8,296,874 | B2 | 10/2012 | Galati, Jr. et al. | |
| 8,380,355 | B2 | 2/2013 | Mayleben | |
| 8,531,048 | B2 | 9/2013 | Tran et al. | |
| 8,657,583 | B2 | 2/2014 | Ward | |
| 8,662,848 | B2 | 3/2014 | Tran | |
| 8,936,444 | B2 | 1/2015 | Drechsel et al. | |
| 8,944,786 | B1 * | 2/2015 | McDougall | H01L 23/043 4/541.3 |
| 9,220,657 | B2 | 12/2015 | Stauber et al. | |
| 9,450,475 | B2 | 9/2016 | Zumstein | |
| 9,551,343 | B2 | 1/2017 | Marks et al. | |
| 9,572,747 | B2 | 2/2017 | Tran et al. | |
| 9,926,933 | B2 * | 3/2018 | Le | F04D 29/0465 |
| 2005/0045621 | A1 | 3/2005 | Chenier et al. | |
| 2005/0262627 | A1 | 12/2005 | Chen | |
| 2006/0096021 | A1 | 5/2006 | Hutchings | |
| 2007/0101489 | A1 | 5/2007 | Hutchings | |
| 2008/0035427 | A1 | 2/2008 | Fowler | |
| 2008/0229819 | A1 | 9/2008 | Mayleben et al. | |
| 2009/0064406 | A1 | 3/2009 | Lawyer et al. | |
| 2009/0094736 | A1 | 4/2009 | Booth et al. | |
| 2010/0074777 | A1 | 3/2010 | Laufer et al. | |
| 2010/0239435 | A1 | 9/2010 | Le et al. | |
| 2011/0004994 | A1 | 1/2011 | Le et al. | |
| 2011/0116948 | A1 | 5/2011 | Yi et al. | |
| 2011/0211982 | A1 * | 9/2011 | Marks | A01K 63/047 417/420 |
| 2011/0223047 | A1 | 9/2011 | Tran et al. | |
| 2011/0253236 | A1 | 10/2011 | Le et al. | |
| 2011/0305562 | A1 | 12/2011 | Matsunaga et al. | |
| 2012/0045352 | A1 | 2/2012 | Lawyer et al. | |
| 2012/0156071 | A1 | 6/2012 | Hijikata et al. | |
| 2013/0022481 | A1 | 1/2013 | Schob et al. | |
| 2013/0263438 | A1 | 10/2013 | Burns et al. | |
| 2014/0377100 | A1 | 12/2014 | Le et al. | |
| 2015/0005682 | A1 * | 1/2015 | Danby | A61H 23/0254 601/101 |
| 2015/0129039 | A1 | 5/2015 | Mulvaney | |
| 2015/0227145 | A1 | 8/2015 | Reddy et al. | |
| 2016/0097668 | A1 | 4/2016 | Vilag | |

FOREIGN PATENT DOCUMENTS

| | | | |
|---|---|---|---|
| CN | 104897239 | A | 9/2015 |
| CN | 204758082 | U | 11/2015 |
| CN | 105592834 | A | 5/2016 |
| EP | 0149132 | | 5/1989 |
| EP | 2676652 | | 12/2013 |
| EP | 2997950 | A2 | 3/2016 |
| GB | 805539 | A | 12/1958 |
| GB | 2156218 | A | 10/1985 |
| JP | H0678858 | | 3/1994 |
| JP | 2007263028 | A | 10/2007 |
| WO | WO2016059409 | A2 | 4/2016 |

OTHER PUBLICATIONS

Lexor Pedicure Spa User Manual (http://uspedicurespa.com/resources/lexor/luminous-spa-pedicure-chair-owner-manual.pdf), Aug. 15, 2016.

Maestro Pedicure Spa Owner's Manual (www.universalcompanies.com/FetchFile.ashx?id=c1571259-e567-4fcc-a079 . . . ), Aug. 15, 2016.

ANS Magnet Liner Jet (ALJ) Pedicure Spa Jet—Complete Set (http://buynailsdirect.com/ans-liner-jet-alj-pedicure-spa-jet-complete-set.html), Aug. 15, 2016.

Auto-Fill Sensor 2.15 (https://lexor.com/Store/Product/Auto-Fill-Sensor-2-15), Aug. 15, 2016.

SpaEquip User Manual (which contains the Sanijet Pipeless Hydrotherapy, Pipeless Whirlpool Foot Bath Owner's Manual for Model: FB2-S115), revised Sep. 2004.

Petra Collection Owner's Manual (which contains instructions for Sanijet-Pipeless System users), last updated Oct. 19, 2004, and copyright 2005.

Hanning document titled "Drain Pumps Synchronous Drain Pumps DPS/DPO," downloaded Aug. 24, 2016.

* cited by examiner

JET ASSEMBLY HAVING A FRICTION-REDUCING MEMBER

BACKGROUND OF THE INVENTION

Field of the Invention

The present invention generally relates to devices, components, and systems in manicure and pedicure industries and in similar industries, such as, but not limited to, the swimming pool industry. More specifically, in a first aspect of the present invention, the invention is directed to a jet assembly comprising at least one friction-reducing device or member. In a second aspect, the present invention is directed to a fluid pump such as a magnetic coupling-type pump, that comprises a motor assembly and a jet assembly comprising at least one friction-reducing member. In a third aspect, the present invention is directed to a method for dispensing or displacing a fluid using the jet assembly comprising at least one friction-reducing member.

Description of the Related Art

Devices, components, and systems in manicure and pedicure industries and in other related industries, such as, but not limited to, swimming pools, are known in the art. Spa devices are used in commercial and recreational settings for hydrotherapy, massage, stimulation, pedicure, and bathing purposes. Typical spa devices include a motor that drives a pump to circulate water from the spa device. In particular, a shaft of the motor is used to directly mount an impeller, which is then used to circulate water into and out of the spa device. Since the motor may not operate wet, a seal or a series of seals may be required to prevent water from entering the motor. The seals will wear to the point where water will enter the motor and consequently, the entering water may cause the motor to burn out or even causes an electric shock. At this point, the motor assembly may be replaced in order to continue operation. This is expensive and may take several hours in which to perform.

In the spa application environment, water is commonly added with certain substances and/or products, such as salt, chemicals, sand, massage lotions, etc. Due to this fact, traditional bearings, such as ball bearings and metal bushings, will not be suitable for a long term and reliable operation. The presence of chemicals and sand, for example, will cause some or many currently available bearings to wear out quicker than normal and result in pump failures.

The present invention overcomes one or more of the shortcomings of devices, components, and systems in manicure and pedicure industries and in other related industries by having a jet assembly that does not include either a shaft member(s) or a bearing(s). The Applicant is unaware of inventions or patents, taken either singly or in combination, which are seen to describe the present invention as claimed.

SUMMARY OF THE INVENTION

In a first aspect of the present invention, the present invention is directed to a jet assembly comprising a jet assembly housing, a magnetic impeller, and at least one friction-reducing device or member. In a second aspect, the present invention is directed to a fluid pump such as a magnetic coupling-type pump, that comprises a motor assembly and a jet assembly comprising a jet assembly housing, a magnetic impeller, and at least one friction-reducing member, and that dispenses or displaces fluid to a work environment or a setting, such as, but not limited, to a foot spa, a spa, a jacuzzi, a bathtub, or a swimming pool. In a third aspect, the present invention is directed to a method for dispensing or displacing a fluid using the jet assembly comprising a jet assembly housing, a magnetic impeller, and at least one friction-reducing member. The at least one friction-reducing device or member allows a motor assembly to cause a magnetic impeller to rotate within a jet assembly housing and preferably not make contact with an inner surface of a base or back cover of the jet assembly housing during operation of the jet assembly such that a shaft member(s) and/or a bearing(s) is/are not required in the present invention for rotation of the magnetic impeller.

In the first aspect of the present invention, a first embodiment of a jet assembly includes: a jet assembly housing; a magnetic impeller; and at least one friction-reducing device or member. The jet assembly may also include an impeller axial alignment member and a vibration noise-reducing member. The jet assembly is adapted for being secured or coupled (preferred to be detachably secured or coupled) to a motor assembly.

In the first aspect of the present invention, a second embodiment of a jet assembly includes: a jet assembly housing; a magnetic impeller; and at least one friction-reducing device or member. The jet assembly may also include an impeller axial alignment member and a heat sink. The jet assembly is adapted for being secured or coupled (preferred to be detachably secured or coupled) to a motor assembly.

The jet assembly housing includes a base or back cover, a cap or front cover, an impeller-receiving chamber, a plurality of inlet apertures, and a plurality of outlet apertures.

Figure 1:
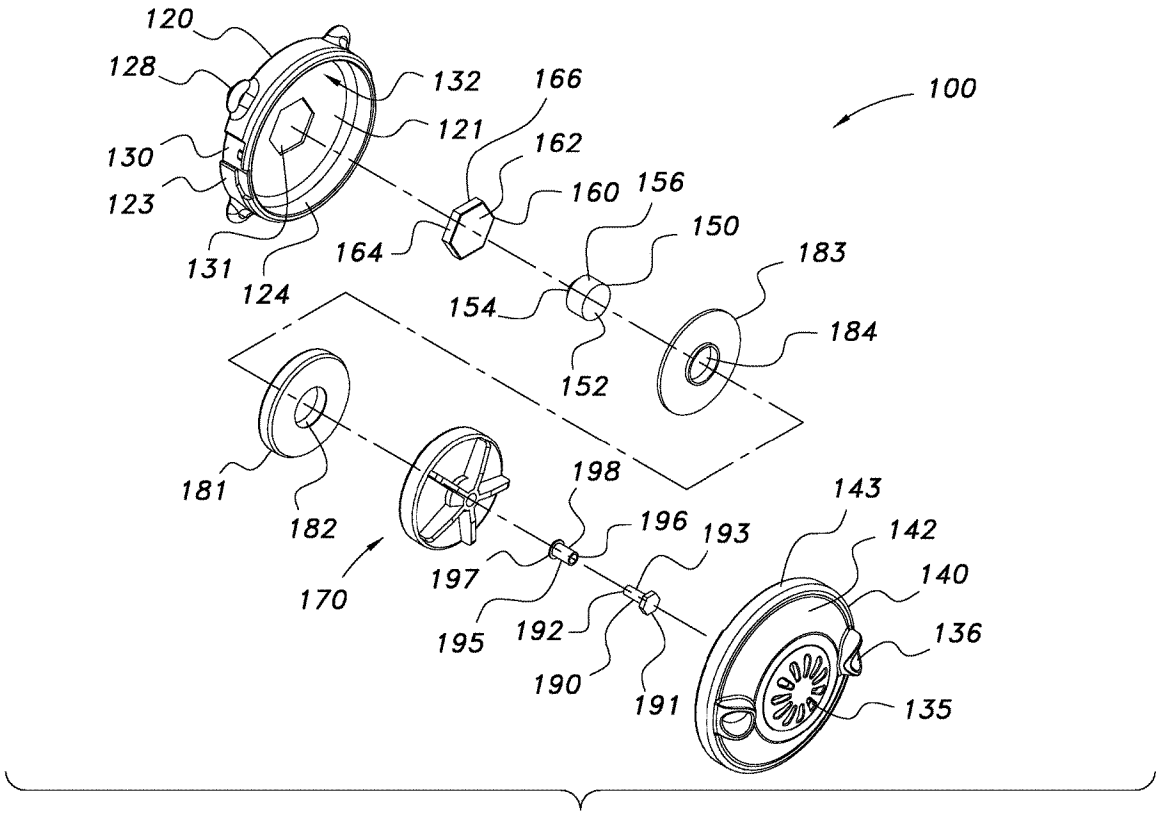
FIG. 1 is an exploded, perspective view of a first embodiment of a jet assembly according to the present invention, showing a jet assembly housing, at least one friction-reducing device or member, a magnetic impeller, an impeller axial alignment member, and a vibration noise-reducing member.
Figure 3:
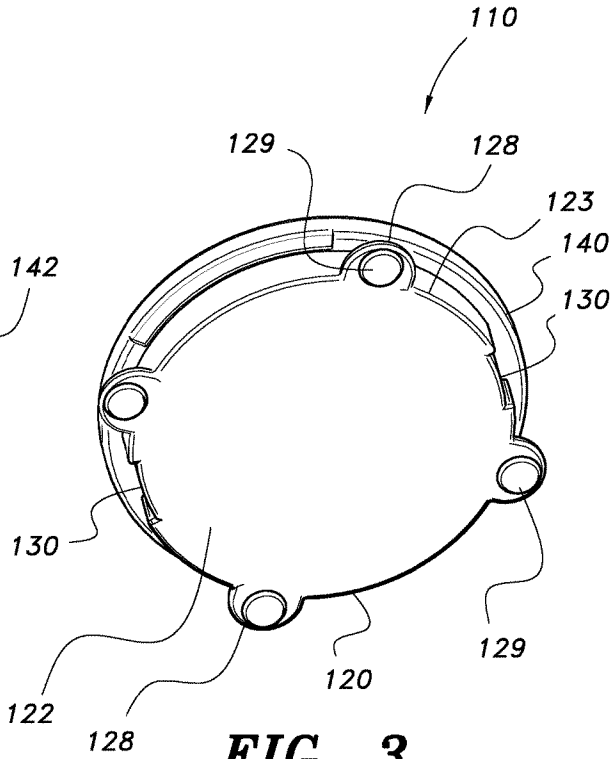
FIG. 3 is an assembly, rear (or bottom) perspective view of the jet assembly housing of FIG. 1.
Figure 2:
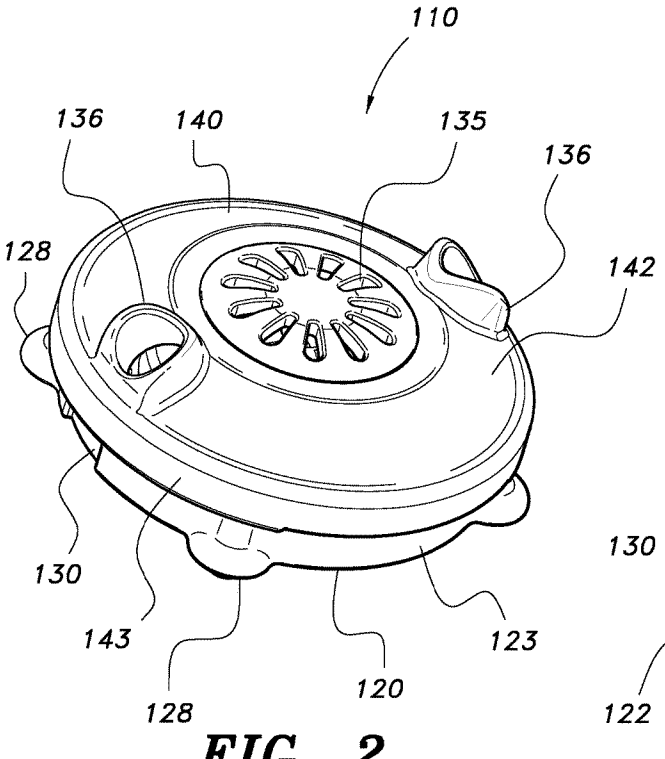
FIG. 2 is an assembly, front (or top) perspective view of the jet assembly housing of FIG. 1.
Figure 5:
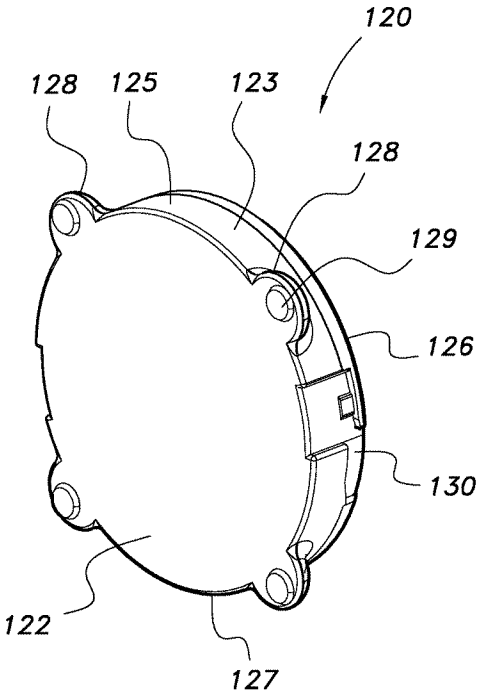
FIG. 5 is a rear (or bottom), side perspective view of the base or back cover of the jet assembly housing of FIG. 1, showing an outer surface of the base or back cover.

It should be understood that the above-attached figures are not intended to limit the scope of the present invention in any way.

DETAILED DESCRIPTION OF THE PREFERRED EMBODIMENTS

Referring to FIGS. 1-26 and in a first aspect of the present invention, the invention is directed to a jet assembly 100,500 comprising at least one friction-reducing device or member 150,160,550,560. In a second aspect, the present invention is directed to a fluid pump 700,800 such as a magnetic coupling-type pump, that comprises a motor assembly 200 and a jet assembly 100,500 comprising at least one friction-reducing member 150,160,550,560, and that dispenses or displaces fluid to a work environment or a setting SET, such as, but not limited, to a foot spa, a spa, a jacuzzi, a bathtub, or a swimming pool. In a third aspect, the present invention is directed to a method for dispensing or displacing a fluid using the jet assembly 100,500 comprising at least one friction-reducing member 150,160,550,560. The at least one friction-reducing device or member 150,160,550,560 allows a motor assembly 200 to cause a magnetic impeller 170,570 to rotate within a jet assembly housing 110,510 during operation of the jet assembly 100,500 such that a shaft member(s) and/or a bearing(s) is/are not required in the present invention for rotation of the magnetic impeller 170,570.

Referring to FIGS. 1-11 and in the first aspect of the present invention, a first embodiment of a jet assembly 100 includes: the jet assembly housing 110; the at least one friction-reducing device or member 150,160; and a magnetic impeller 170. The jet assembly 100 may also include an impeller axial alignment member 190 and a vibration noise-reducing member 195. The jet assembly 100 is adapted for being secured or coupled (preferred to be detachably secured or coupled) to a motor assembly 200.

As shown in FIGS. 1-7 and 10-11, the jet assembly housing 110 includes a base or back cover 120, a cap or front cover 140, an impeller-receiving chamber 132, a plurality of inlet apertures 135, and a plurality of outlet apertures 136.

As best shown in FIGS. 1-5 and 10-11, the base or back cover 120 of the jet assembly housing 110 has an inner surface 121, an outer surface 122, a circular wall 123 at or about the periphery of the back cover 120, a plurality of feet extensions 128, a plurality of engagement recesses or grooves 130, and a cavity or recess 131 dimensioned and configured for receiving the second friction-reducing member or device 160. Preferably, the outer surface 122 is generally flat or has a generally flat, centrally-located section 133 that allows for a liner (not shown) to be positioned behind (or below) the back cover 120 of the jet assembly housing 110 and in front of (or above) the contact surface of the setting SET and motor assembly 200. The circular wall 123 has an inner surface 124, an outer surface 125, a front or top 126, and a rear or bottom 127. Each of the plurality of feet extensions 128 extends outwardly from about the rear or bottom 127 of the circular wall 123, and has a knob 129 extending rearwardly or downwardly from the corresponding feet extension 128 for engaging with the mounting housing member 250. Each of the plurality of engagement recesses or grooves 130 is positioned at a predetermined location about the outer surface 125 of the circular wall 123 for engaging with and securing the front cover 140. The cavity or recess 131 is preferentially located about the center area of the inner surface 121 of the back cover 120. The back cover 120 may be made or manufactured of plastic, hard plastic, and/or any other suitable material known to one of ordinary skill in the art.

As best shown in FIGS. 1-2, 6-7 and 10-11, the cap or front cover 140 of the jet assembly housing 110 has an inner surface 141, an outer surface 142, a circular wall 143 at or about the periphery of the front cover 140, a plurality of engagement latches 148, a plurality of inlet apertures 135, and a plurality of outlet apertures 136. The circular wall 143 has an inner surface 144, an outer surface 145, a front or top 146, and a rear or bottom 147. Each of the plurality of engagement latches 148 is positioned at a predetermined location about the inner surface 144 of the circular wall 143 for engaging with a corresponding engagement recess or groove 130 of the back cover 120 such that the back cover 120 and front cover 140 may be detachably secured to one another prior to and during operation or use and also may be detachably unsecured from one another after operation or use for allowing access to the components, maintenance, etc. The front cover 140 may be made or manufactured of plastic, hard plastic, and/or any other suitable material known to one of ordinary skill in the art.

Figure 4:
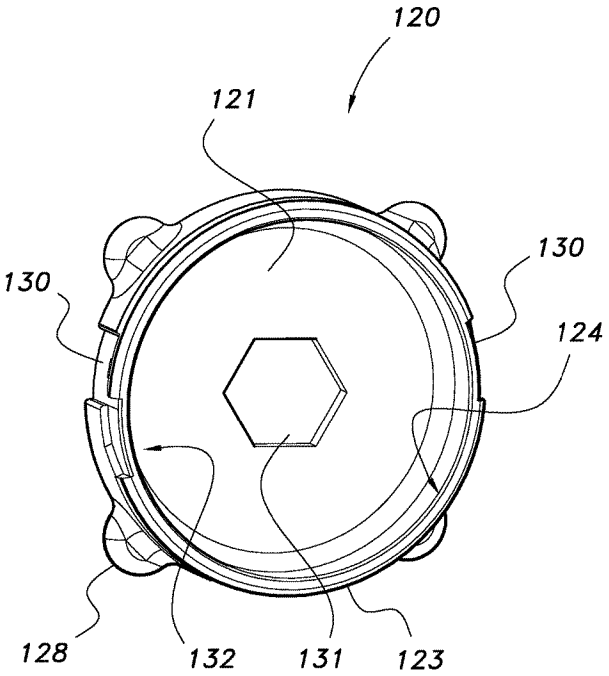
FIG. 4 is a front (or top) perspective view of the base or back cover of the jet assembly housing of FIG. 1, showing an inner surface of the base or back cover.
Figure 7:
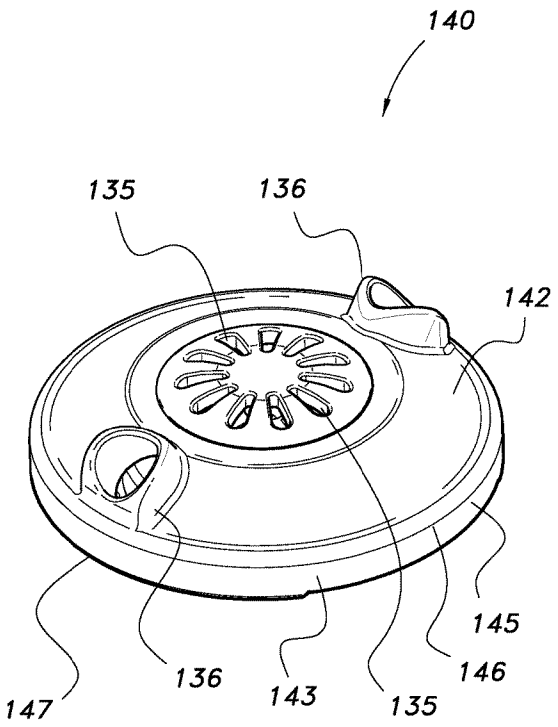
FIG. 7 is a front (or top) perspective view of the cap or front cover of the jet assembly housing of FIG. 1, showing an outer surface of the cap or front cover.
Figure 6:
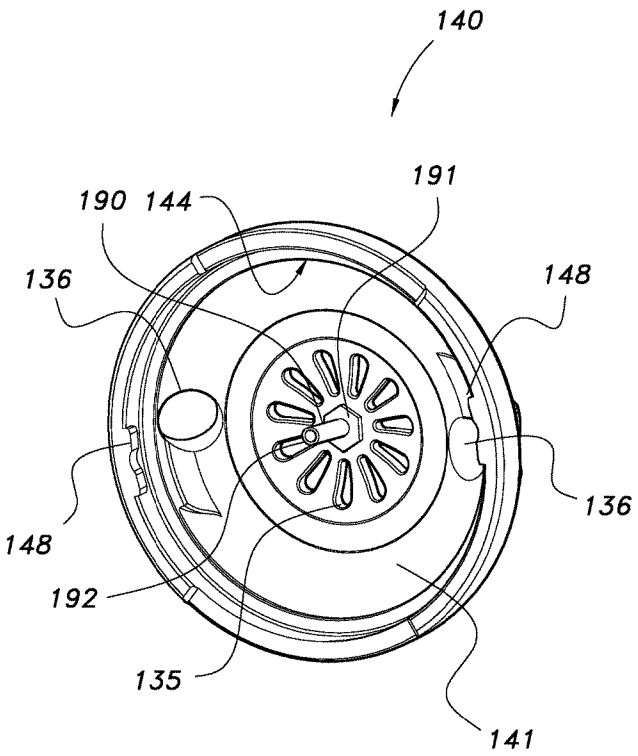
FIG. 6 is a rear (or bottom) perspective view of the cap or front cover of the jet assembly housing of FIG. 1, showing an inner surface of the cap or front cover.
Figure 9:
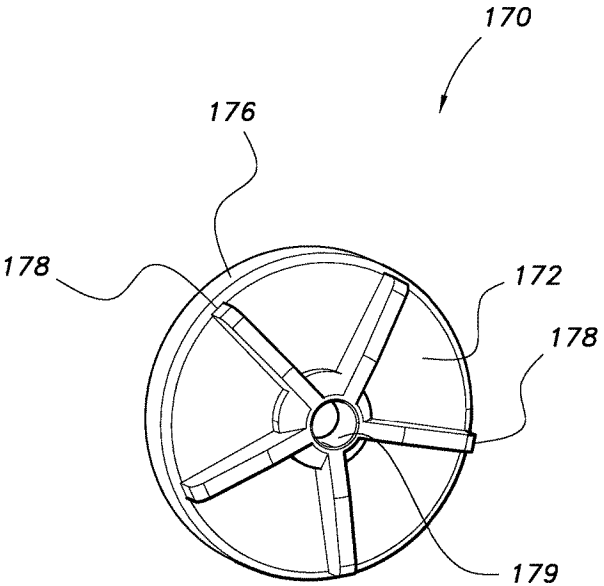
FIG. 9 is a front (or top), side perspective view of the magnetic impeller of the jet assembly of FIG. 1.
Figure 8:
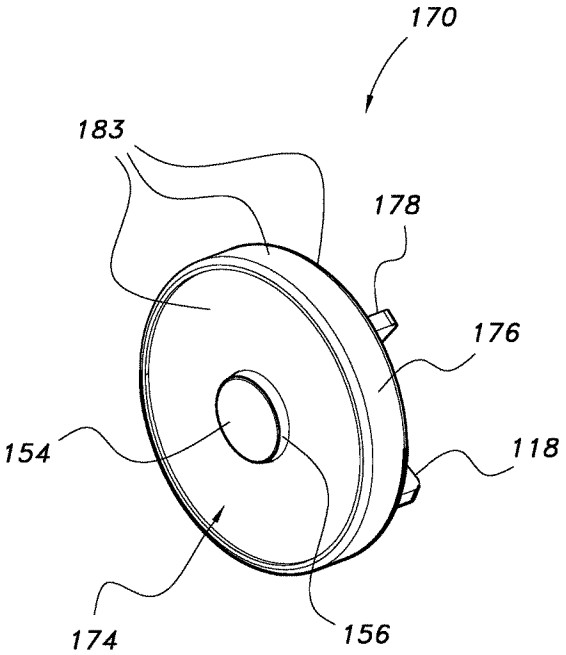
FIG. 8 is a rear (or bottom), side perspective view of the magnetic impeller of the jet assembly of FIG. 1, showing the first friction-reducing member secured to and protruding from the cavity of the magnetic impeller.
Figure 10:
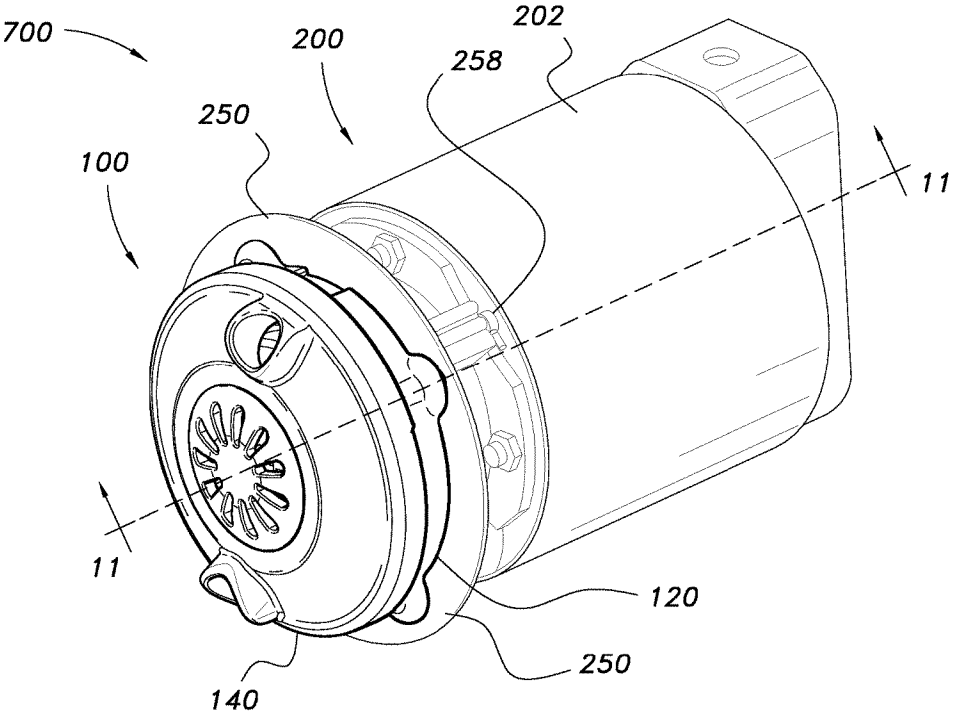
FIG. 10 is an assembly, front (or top) perspective view of a fluid pump according to the present invention, showing the jet assembly of FIG. 1 being secured to a motor assembly.
Figure 11:
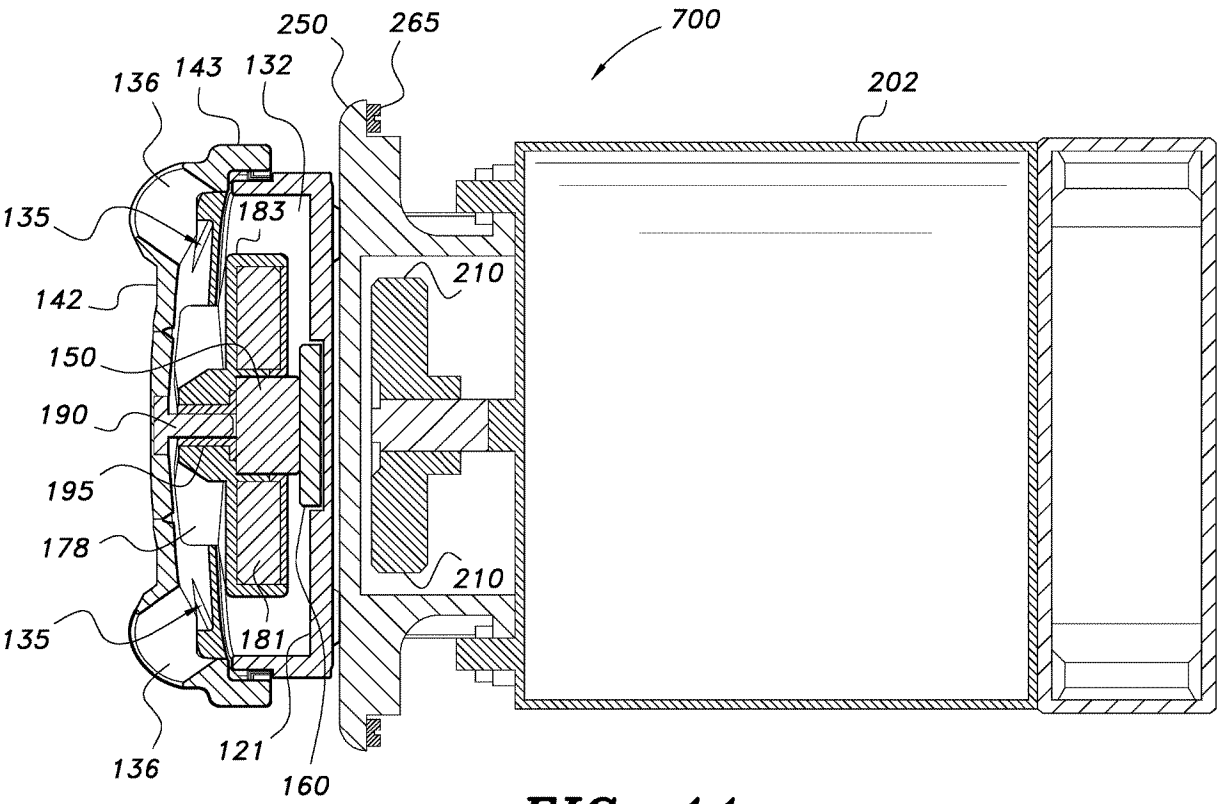
FIG. 11 is a cross-sectional view of the fluid pump of FIG. 10.

As shown in FIGS. 1, 4 and 11, the impeller-receiving chamber 132 is defined by the back cover 120 and front cover 140 when the back cover 120 and front cover 140 are secured to one another. The impeller-receiving chamber 132 is dimensioned and configured to allow the magnetic impeller 170 to rotate within the impeller-receiving chamber 132 during operation.

As shown in FIGS. 1-2, 6-7 and 10-11, the plurality of inlet apertures 135 are dimensioned and configured to allow a fluid to enter the jet assembly housing 110 during operation or use and are preferably disposed or located about the central area of the front cover 140. Preferably, the plurality of inlet apertures 135 form a diameter that is about equal to or smaller than the diameter of the magnetic impeller 170 so that there's a decreased chance of mixing between the inflow fluid and outflow fluid.

As shown in FIGS. 1-2, 6-7 and 10-11, the plurality of outlet apertures 136 are dimensioned and configured to allow the fluid to exit or be dispensed or displaced from the jet assembly housing 110 into the setting SET during operation or use and are preferably disposed or located about the periphery of the front cover 140. Preferably, each of the outlet apertures 136 has a nozzle. Preferably, each of the nozzles and an axis of the fluid pump 700,800 form an angle less than 90 degree.

As shown in FIGS. 1, 8-9 and 11, the magnetic impeller 170, preferably a planar magnetic impeller 170, has an outer diameter and a "disc-like" configuration or shape, and includes a front side 172, a rear side 174, a sidewall 176, a circular array of arm members 178 positioned on the front side 172, and a cavity 179, preferably a centrally-disposed or a centrally-located cavity 179, dimensioned and configured for receiving the first, friction-reducing member 150, the impeller axial alignment member 190, and the vibration noise-reducing member 195. The centrally-disposed cavity 179 preferably extends from the front side 172 through to the rear side 174. The magnetic impeller 170 is dimensioned and configured to rotate within the jet assembly housing 110 (when the back cover 120 and front cover 140 are secured to one another), within the impeller-receiving chamber 132, and preferably at or about a central area of the inner surface 121 of the back cover 120 during operation via assistance from the impeller axial alignment member 190 (at initial operation) and from the motor assembly 200 (at initial operation and during operation).

Preferably and as a non-limiting example, the magnetic impeller 170 contains a magnetic plate or disc 181 that is preferably substantially or fully enclosed within an exterior or cover 183 preferably made or manufactured of plastic, rubber, a rubber-like material, or any combination thereof. Preferably, each of the magnetic plate or disc 181 and exterior or cover 183 also has a cavity or hole 182,184 (preferably a centrally-disposed or a centrally-located cavity or hole), respectively, for accommodating the first, friction-reducing member 150. It is obvious to one of ordinary skill in the art that the magnetic impeller 170 may be other types of magnetic impellers that is know in the art. In addition, it is obvious to one of ordinary skill in the art that the exterior or cover 183 of the magnetic impeller 170 may be made or manufactured of any material that is know in the art.

In use or operation, the magnetic disc 181 of the magnetic impeller 170 is coupled to the driven magnetic disc 210 by a magnetic coupling field to rotate the magnetic impeller 170 such that rotation of the magnetic impeller 170 causes the fluid to flow into the inlet apertures 135 and out of the outlet apertures 136.

As shown in FIGS. 1 and 11, the at least one friction-reducing member 150,160 is comprised of the first, friction-reducing member 150 and second, friction-reducing member 160, which both serve to allow the motor assembly 200 to cause the magnetic impeller 170 to rotate within the jet assembly housing 110 and the impeller-receiving chamber 132 during operation of the jet assembly 100. Preferably, the first, friction-reducing member 150 and second, friction-reducing member 160 make no (even though they 150,160 are preferably substantially close to one another 150,160), minimal, slight or some contact with one another 150,160 during operation of the jet assembly 100 such that normal operation of the jet assembly 100 is sufficient and efficient and that replacement of the first, friction-reducing member 150 and second, friction-reducing member 160 due to wear and tear is not out of the ordinary nor frequent.

As best shown in FIG. 1, the first, friction-reducing member 150 has a first end 152, a second end 154, and a cylindrical body 156 extending between the first and second ends 152,154. As a non-limiting example, the second end 154 is generally flat in a width-wise direction. Alternatively, the second end 154 may be configured of a semi-spherical shape in a width-wise direction, like second end 554, or any other configuration or shape where some, most or all of the second end 154 makes contact (or being sufficiently close enough to have the jet assembly 100 perform as intended while not making contact) with the first side or surface 162 of the second, friction-reducing member 160. The first, friction-reducing member 150 is dimensioned and configured for being partially or fully secured in or for fitting, preferably closely or tightly fitting, within the centrally-disposed or centrally located cavity 179,182,184 of the magnetic impeller 170, magnetic plate or disc 181, and exterior or cover 183, respectively.

As best shown in FIG. 1, the second, friction-reducing member 160 has a first side or surface 162, a second side or surface 164, and a sidewall 166. The second, friction-reducing member 160 is dimensioned and configured for being partially or fully secured in or for fitting, preferably closely or tightly fitting, within the cavity or recess 131 of the back cover 120 of the jet assembly housing 110. As a non-limiting example, the first side or surface 162 is generally flat in a width-wise direction. Alternatively, the first side or surface 162 may be configured of any other configuration or shape in a width-wise direction where some, most or all of the first side or surface 162 makes contact (or being sufficiently close enough to have the jet assembly 100 perform as intended while not making contact) with the second end 152 of the first, friction-reducing member 150. As a non-limiting example, the second, friction-reducing member 160 has a hexagonal configuration. As a non-limiting example, the back cover 120 of the jet assembly housing 110 may not include the cavity or recess 131 and, so, the second, friction-reducing member 160 may then be secured to the inner surface 121, itself, of the back cover 120 by any method known to one of ordinary skill in the art such that operation of the jet assembly 100 is sufficiently effective. Preferably, at least one of the first, friction-reducing member 150 and second, friction-reducing member 160 is made or manufactured of a hard material, such as, but not limited to, ceramic, carbon, steel, any material(s) known to one of ordinary skill in the art, and any combination thereof.

The impeller axial alignment member 190, at initial operation of the jet assembly 100, helps the magnetic impeller 170 rotate preferably at or about the central area within the impeller-receiving chamber 132. As best shown in FIG. 1, the impeller axial alignment member 190 comprises a first end 191, a second end 192, and a body 193 extending between the first end 191 and second end 192. As a non-limiting example and as best shown in FIG. 11, the impeller axial alignment member 190 extends downwardly (preferably about a central area of the inner surface 141 of the front cover 140) from the inner surface 141 of the front cover 140 toward the magnetic impeller 170 and the inner surface 121 of the back cover 120 such that, preferably, the axis of the impeller axial alignment member 190 is parallel to or in alignment with the axis of rotation of the magnetic impeller 170. As a non-limiting example, the impeller axial alignment member 190 may be secured (detachably or permanently) to the inner surface 141 (preferably about the central area of the inner surface 141) of the front cover 140. The impeller axial alignment member 190 is preferably made or manufactured of a metal or a hard material, such as, but not limited to, steel, a hard plastic, any material(s) known to one of ordinary skill in the art, and any combination thereof.

The vibration noise-reducing member 195 reduces vibration noise produced by the rotation of the magnetic impeller 170 during operation. As best shown in FIG. 1, the vibration noise-reducing member 195 comprises a first end 196, a second end 197, a body 198 extending between the first end 196 and second end 197, and a cavity 199 extending between the first end 196 and second end 197. The cavity 199 is dimensioned and configured to receive the body 193 of the impeller axial alignment member 190. As a non-limiting example, the vibration noise-reducing member 195 and impeller axial alignment member 190 are secured to one another where the body 193 of the impeller axial alignment member 190 is positioned within the cavity 199 of the vibration noise-reducing member 195. The vibration noise-reducing member 195 is preferably made or manufactured of a rubber or rubber-like material, any material(s) known to one of ordinary skill in the art, and any combination thereof.

When the front cover 140 of the jet assembly housing 110 is secured to the back cover 120, it is preferred in a non-limiting example that the vertical distance from a highest point of the impeller arm members 178 to the lowest inlet aperture 135 on the inner surface 141 of the front cover 140 is less than or equal to about half of an inch.

Referring to FIGS. 12-22, in the first aspect of the present invention, a second embodiment of a jet assembly 500 includes: the jet assembly housing 510; the at least one friction-reducing device or member 550,560; and a magnetic impeller 570. The jet assembly 500 may also include an impeller axial alignment member 590 and a heat sink 600. The jet assembly 500 is adapted for being secured or coupled (preferred to be detachably secured or coupled) to a motor assembly 200.

As shown in FIGS. 12-18 and 21-22, the jet assembly housing 510 includes a base or back cover 520, a cap or front cover 540, an impeller-receiving chamber 532, a plurality of inlet apertures 535, and a plurality of outlet apertures 536.

As best shown in FIGS. 12-16 and 21-22, the base or back cover 520 of the jet assembly housing 510 has an inner surface 521, an outer surface 522, a circular wall 523 at or about the periphery of the back cover 520, a plurality of feet extensions 528, a plurality of engagement recesses or grooves 530, and a cavity or recess 531 dimensioned and configured for receiving the second friction-reducing member or device 560 (or the heat sink 600 when the heat sink 600 is desired or needed). Preferably, the outer surface 522 is generally flat or has a generally flat, centrally-located section 533 that allows for a liner (not shown) to be positioned behind (or below) the back cover 520 of the jet assembly housing 510 and in front of (or above) the contact surface of the setting SET and motor assembly 200. The circular wall 523 has an inner surface 524, an outer surface 525, a front or top 526, and a rear or bottom 527. Each of the plurality of feet extensions 528 extends outwardly from about the rear or bottom 527 of the circular wall 523, and has a knob 529 extending rearwardly or downwardly from the corresponding feet extension 528 for engaging with the mounting housing member 250. Each of the plurality of engagement recesses or grooves 530 is positioned at a predetermined location about the outer surface 525 of the circular wall 523 for engaging with and securing the front cover 540. The cavity or recess 531 is preferentially located about the center area of the inner surface 521 of the back cover 520. The back cover 520 may be made or manufactured of plastic, hard plastic, and/or any other suitable material known to one of ordinary skill in the art.

As best shown in FIGS. 12-13, 17-18 and 21-22, the cap or front cover 540 of the jet assembly housing 510 has an inner surface 541, an outer surface 542, a circular wall 543 at or about the periphery of the front cover 540, a plurality of engagement latches 548, a plurality of inlet apertures 535, and a plurality of outlet apertures 536. The circular wall 543 has an inner surface 544, an outer surface 545, a front or top 546, and a rear or bottom 547. Each of the plurality of engagement latches 548 is positioned at a predetermined location about the inner surface 544 of the circular wall 543 for engaging with a corresponding engagement recess or groove 530 of the back cover 520 such that the back cover 520 and front cover 540 may be detachably secured to one another prior to and during operation or use and also may be detachably unsecured from one another after operation or use for allowing access to the components, maintenance, etc. The front cover 540 may be made or manufactured of plastic, hard plastic, and/or any other suitable material known to one of ordinary skill in the art.

Figure 12:
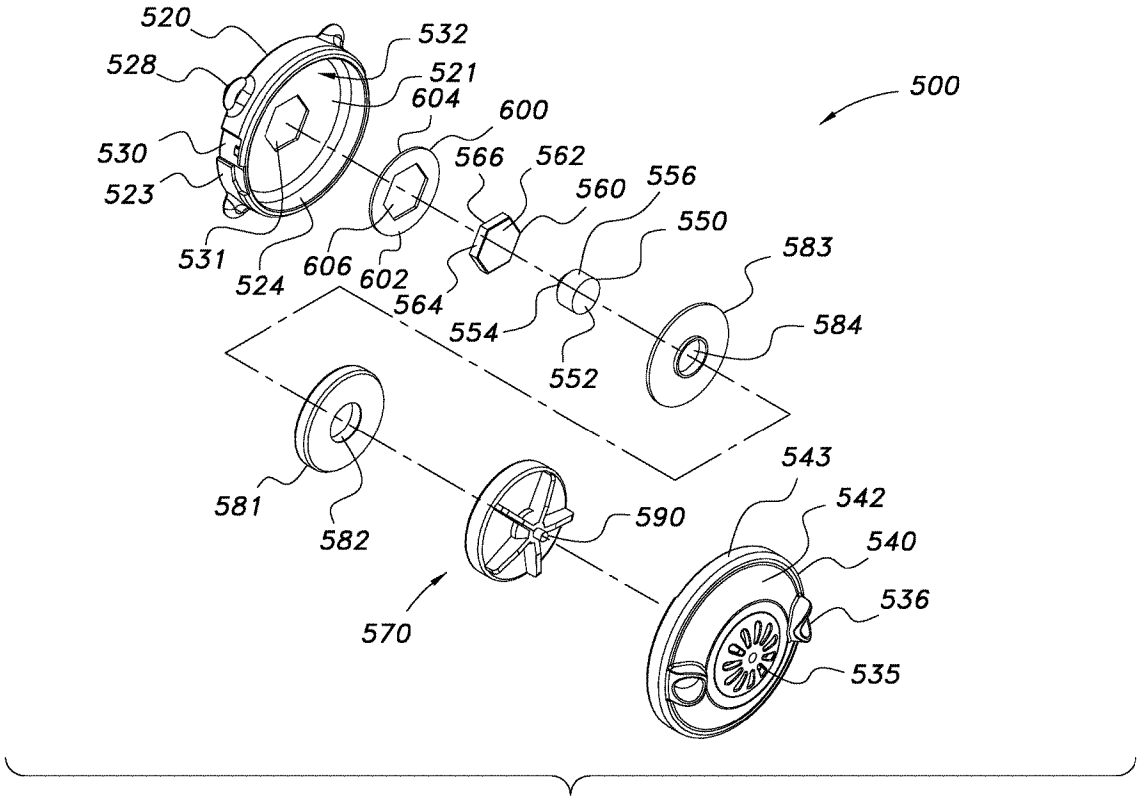
FIG. 12 is an exploded, perspective view of a second embodiment of a jet assembly according to the present invention, showing a jet assembly housing, at least one friction-reducing device or member, a magnetic impeller, an impeller axial alignment member, and a heat sink.
Figure 14:
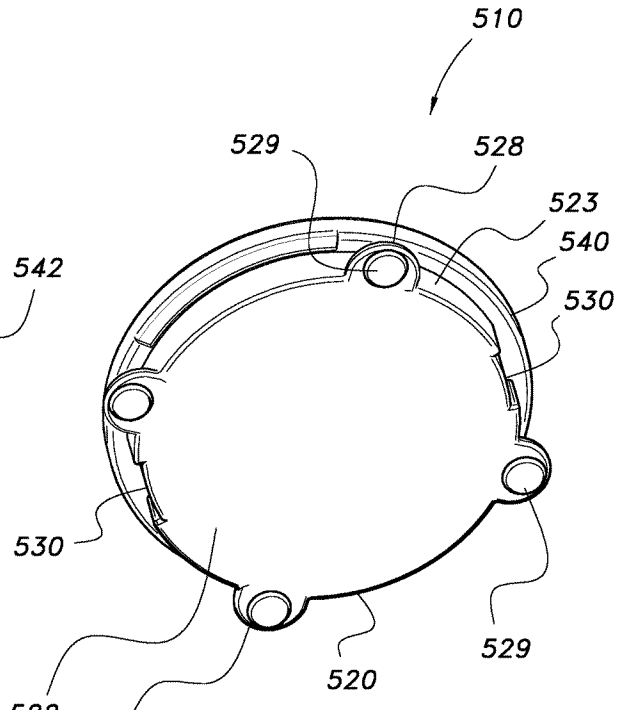
FIG. 14 is an assembly, rear (or bottom) perspective view of the jet assembly housing of FIG. 12.
Figure 13:
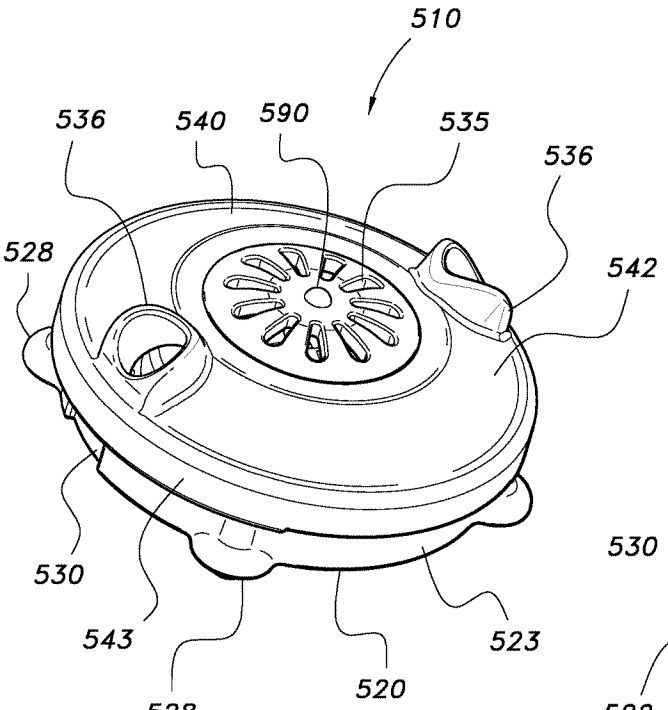
FIG. 13 is an assembly, front (or top) perspective view of the jet assembly housing of FIG. 12.
Figure 16:
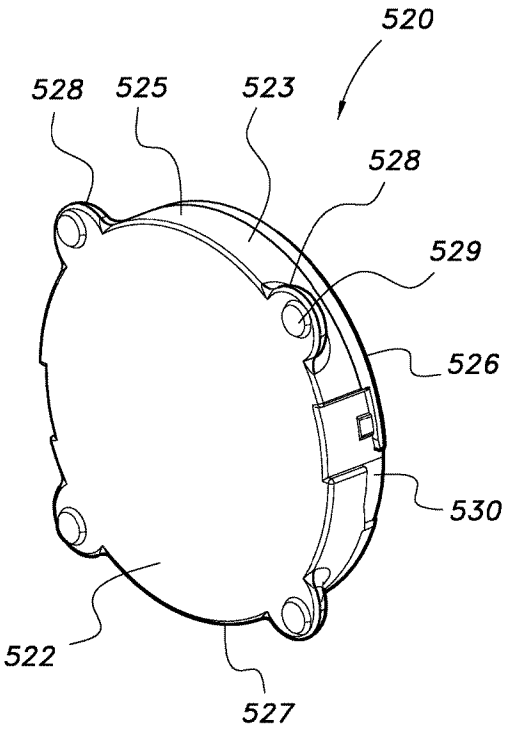
FIG. 16 is a rear (or bottom), side perspective view of the base or back cover of the jet assembly housing of FIG. 12, showing an outer surface of the base or back cover.
Figure 15:
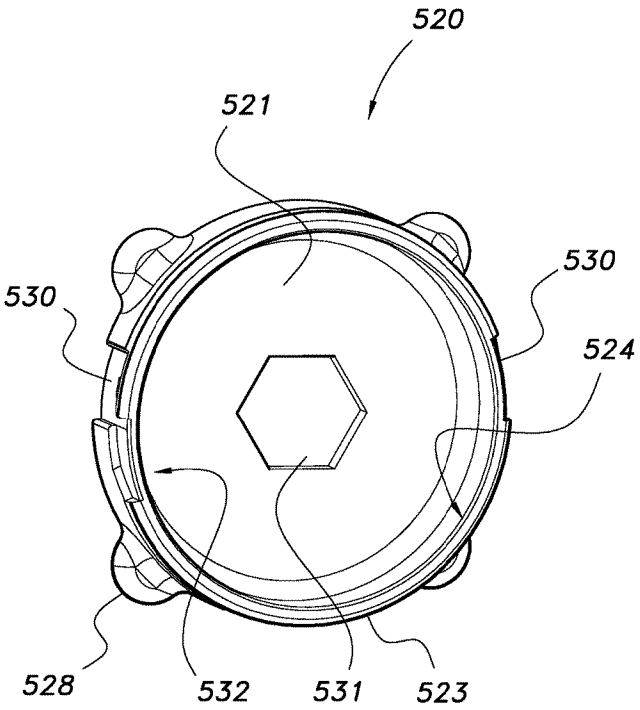
FIG. 15 is a front (or top) perspective view of the base or back cover of the jet assembly housing of FIG. 12, showing an inner surface of the base or back cover.
Figure 18:
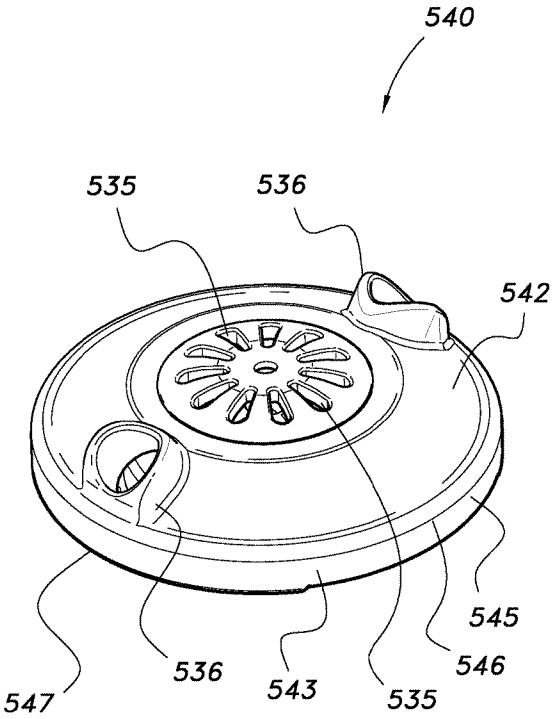
FIG. 18 is a front (or top) perspective view of the cap or front cover of the jet assembly housing of FIG. 12, showing an outer surface of the cap or front cover.
Figure 17:
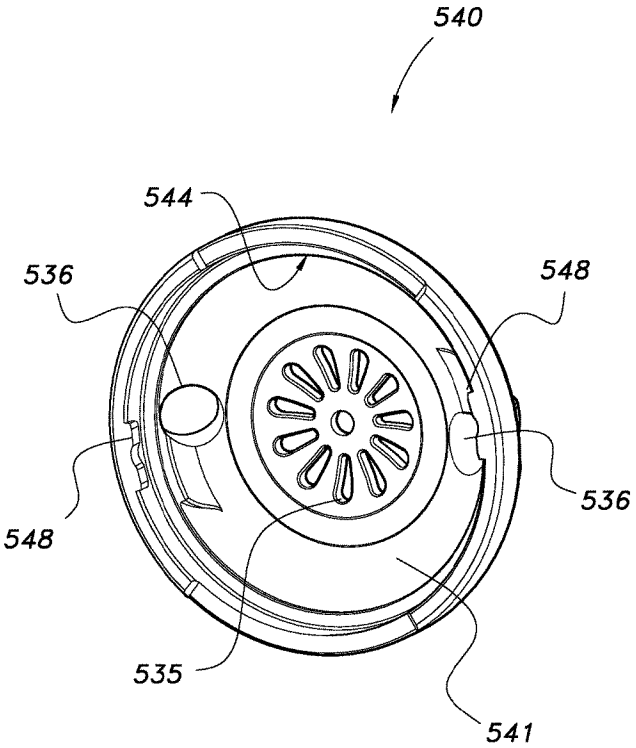
FIG. 17 is a rear (or bottom) perspective view of the cap or front cover of the jet assembly housing of FIG. 12, showing an inner surface of the cap or front cover.
Figure 20:
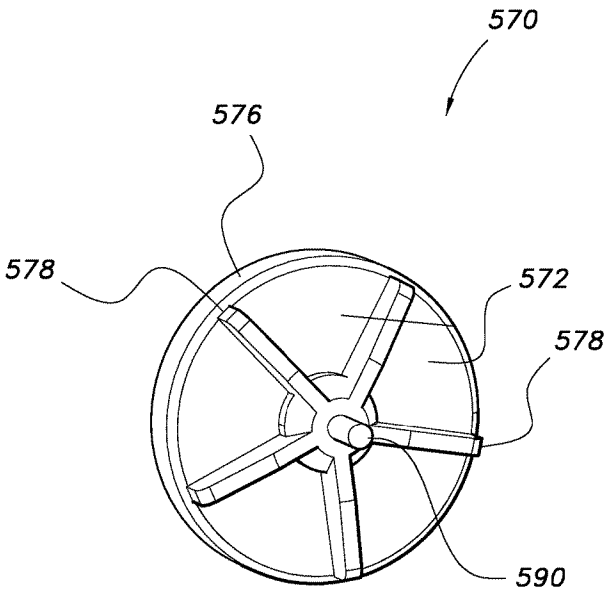
FIG. 20 is a front (or top), side perspective view of the magnetic impeller of the jet assembly of FIG. 12.
Figure 19:
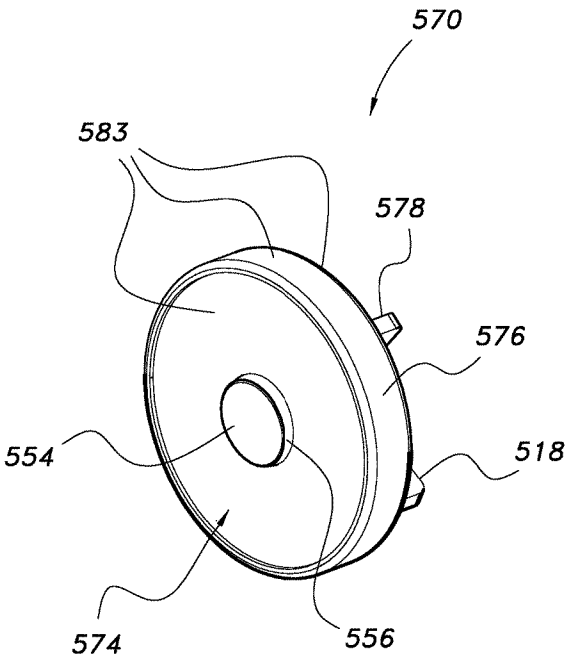
FIG. 19 is a rear (or bottom), side perspective view of the magnetic impeller of the jet assembly of FIG. 12, showing the first friction-reducing member secured to and protruding from the cavity of the magnetic impeller.
Figure 21:
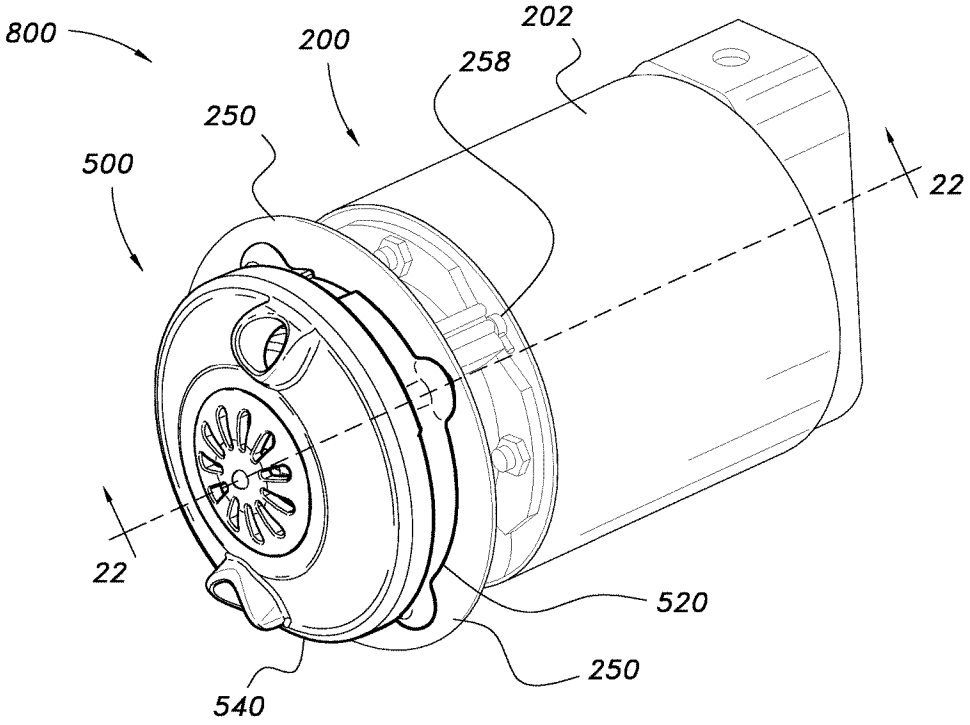
FIG. 21 is an assembly, front (or top) perspective view of a fluid pump according to the present invention, showing the jet assembly of FIG. 12 being secured to a motor assembly.
Figure 22:
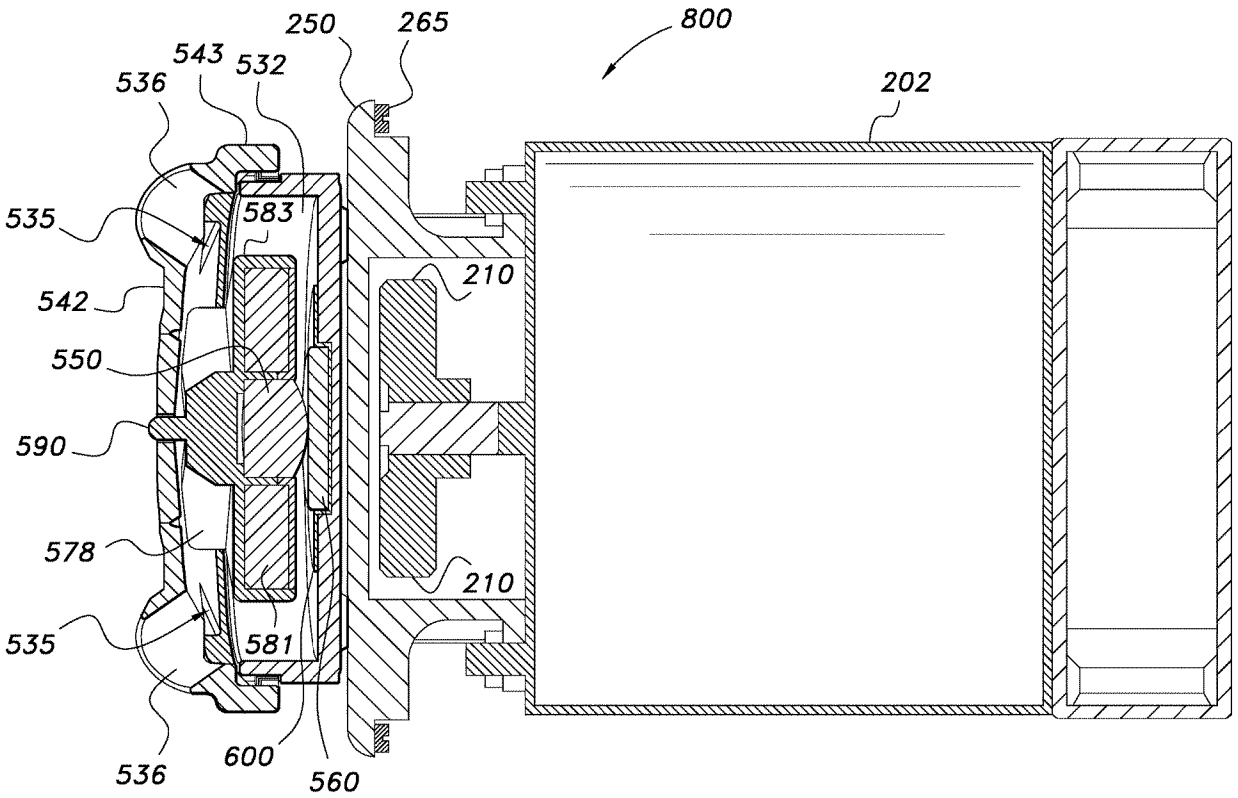
FIG. 22 is a cross-sectional view of the fluid pump of FIG. 21.
Figure 23:
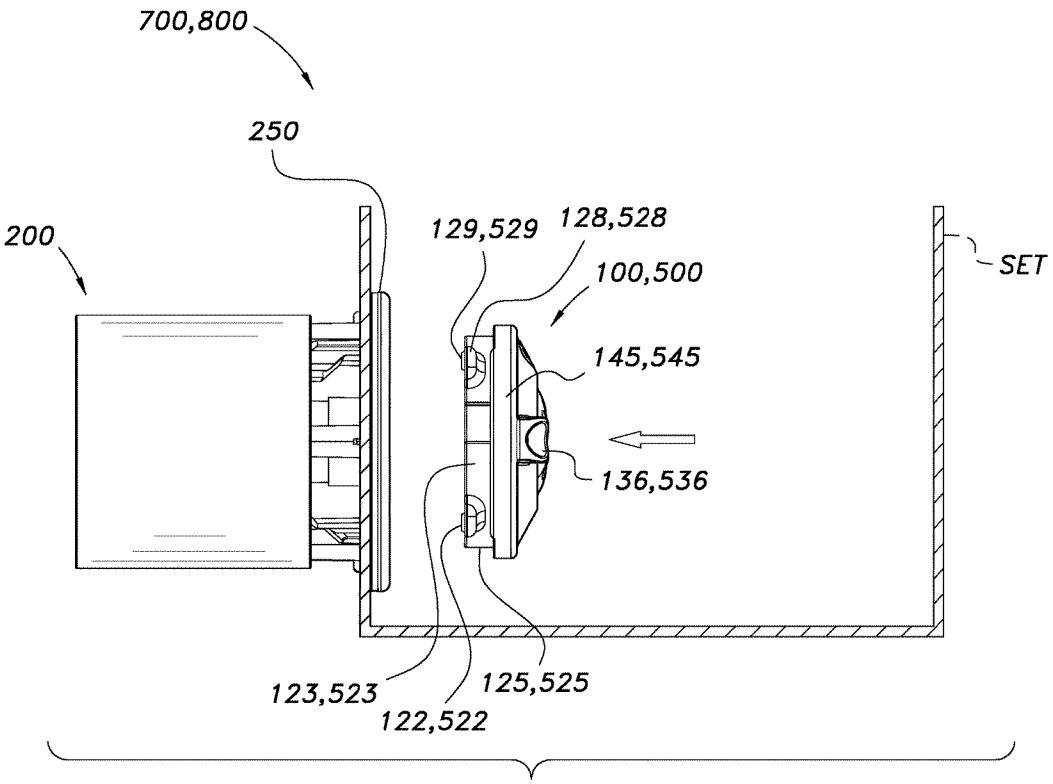
FIG. 23 is a right side, partial cross-sectional, environmental view of the fluid pump of FIG. 10, wherein the motor assembly is secured to or proximate to a setting, such as an internal wall of a foot spa, while the jet assembly will be secured or coupled to or about the motor assembly prior to operation or use.

As shown in FIGS. 12, 15 and 22, the impeller-receiving chamber 532 is defined by the back cover 520 and front cover 540 when the back cover 520 and front cover 540 are secured to one another. The impeller-receiving chamber 532 is dimensioned and configured to allow the magnetic impeller 570 to rotate within the impeller-receiving chamber 532 during operation.

As shown in FIGS. 12-13, 17-18 and 21-22, the plurality of inlet apertures 535 are dimensioned and configured to allow a fluid to enter the jet assembly housing 510 during operation or use and are preferably disposed or located about the central area of the front cover 540. Preferably, the plurality of inlet apertures 535 form a diameter that is about equal to or smaller than the diameter of the magnetic impeller 570 so that there's a decreased chance of mixing between the inflow fluid and outflow fluid.

As shown in FIGS. 12-13, 17-18 and 21-22, the plurality of outlet apertures 536 are dimensioned and configured to allow the fluid to exit or be dispensed or displaced from the jet assembly housing 510 into the setting SET during operation or use and are preferably disposed or located about the periphery of the front cover 540. Preferably, each of the outlet apertures 536 has a nozzle. Preferably, each of the nozzles and an axis of the fluid pump 700,800 form an angle less than 90 degree.

As shown in FIGS. 12, 19-20 and 22, the magnetic impeller 570, preferably a planar magnetic impeller 570, has an outer diameter and a "disc-like" configuration or shape, and includes a front side 572, a rear side 574, a sidewall 576, a circular array of arm members 578 positioned on the front side 572, and a cavity 579, preferably a centrally-disposed or a centrally-located cavity 579, dimensioned and configured for receiving the first, friction-reducing member 550. The centrally-disposed cavity 579 preferably extends from the front side 572 through to the rear side 574. The magnetic impeller 570 is dimensioned and configured to rotate within the jet assembly housing 510 (when the back cover 520 and front cover 540 are secured to one another), within the impeller-receiving chamber 532, and preferably at or about a central area of the inner surface 521 of the back cover 520 during operation via assistance from the impeller axial alignment member 590 and from the motor assembly 200.

Preferably and as a non-limiting example, the magnetic impeller 570 contains a magnetic plate or disc 581 that is preferably substantially or fully enclosed within an exterior or cover 583 preferably made or manufactured of plastic, rubber, a rubber-like material, or any combination thereof. Preferably, each of the magnetic plate or disc 581 and exterior or cover 583 also has a cavity or hole 582,584 (preferably a centrally-disposed or a centrally-located cavity or hole), respectively, for accommodating the first, friction-reducing member 550. It is obvious to one of ordinary skill in the art that the magnetic impeller 570 may be other types of magnetic impellers that is know in the art. In addition, it is obvious to one of ordinary skill in the art that the exterior or cover 583 of the magnetic impeller 570 may be made or manufactured of any material that is know in the art.

In use or operation, the magnetic disc 581 of the magnetic impeller 570 is coupled to the driven magnetic disc 210 by a magnetic coupling field to rotate the magnetic impeller 570 such that rotation of the magnetic impeller 570 causes the fluid to flow into the inlet apertures 535 and out of the outlet apertures 536.

As shown in FIGS. 12 and 22, the at least one friction-reducing member 550,560 is comprised of the first, friction-reducing member 550 and second, friction-reducing member 560, which both serve to allow the motor assembly 200 to cause the magnetic impeller 570 to rotate within the jet assembly housing 510 and the impeller-receiving chamber 532 during operation of the jet assembly 500. Preferably, the first, friction-reducing member 550 and second, friction-reducing member 560 make no (even though they 550,560 are preferably substantially close to one another 550,560), minimal, slight or some contact with one another 550,560 during operation of the jet assembly 500 such that normal operation of the jet assembly 500 is sufficient and efficient and that replacement of the first, friction-reducing member 550 and second, friction-reducing member 560 due to wear and tear is not out of the ordinary nor frequent.

As shown in FIG. 12, the first, friction-reducing member 550 has a first end 552, a second end 554, and a cylindrical body 556 extending between the first and second ends 552,554. As a non-limiting example, the second end 554 is configured of a semi-spherical shape in a width-wise direction. Alternatively, the second end 554 may be configured generally flat in a width-wise direction, like second end 154, or any other configuration or shape where some, most or all of the second end 554 makes contact (or being sufficiently close enough to have the jet assembly 500 perform as intended while not making contact) with the first side or surface 562 of the second, friction-reducing member 560. The first, friction-reducing member 550 is dimensioned and configured for being partially or fully secured in or for fitting, preferably closely or tightly fitting, within the centrally-disposed or centrally located cavity 579,582,584 of the magnetic impeller 570, magnetic plate or disc 581, and exterior or cover 583, respectively.

As shown in FIG. 12, the second, friction-reducing member 560 has a first side or surface 562, a second side or surface 564, and a sidewall 566. The second, friction-reducing member 560 is dimensioned and configured for being partially or fully secured in or for fitting, preferably closely or tightly fitting, within the cavity or recess 531 of the back cover 520 of the jet assembly housing 510. As a non-limiting example, the first side or surface 562 is generally flat in a width-wise direction. Alternatively, the first side or surface 562 may be configured of any other configuration or shape in a width-wise direction where some, most or all of the first side or surface 562 makes contact (or being sufficiently close enough to have the jet assembly 500 perform as intended while not making contact) with the second end 552 of the first, friction-reducing member 550. As a non-limiting example, the second, friction-reducing member 560 has a hexagonal configuration. As a non-limiting example, the back cover 520 of the jet assembly housing 510 may not include the cavity or recess 531 and, so, the second, friction-reducing member 560 may then be secured to the inner surface 521, itself, of the back cover 520 by any method known to one of ordinary skill in the art such that operation of the jet assembly 500 is sufficiently effective. Preferably, at least one of the first, friction-reducing member 550 and second, friction-reducing member 560 is made or manufactured of a hard material, such as, but not limited to, ceramic, carbon, steel, any material(s) known to one of ordinary skill in the art, and any combination thereof.

The impeller axial alignment member 590 helps the magnetic impeller 570 rotate preferably at or about the central area within the impeller-receiving chamber 532. As a non-limiting example and as best shown in FIG. 12, the impeller axial alignment member 590 preferably is a part or component of the magnetic impeller 570 and extends upwardly (or forwardly) from the central area of the top (or front) of the magnetic impeller 570 toward the inner surface 541 of the front cover 540 such that, preferably, the axis of the impeller axial alignment member 590 is parallel to or in alignment with the axis of rotation of the magnetic impeller 570. As a non-limiting example, the impeller axial alignment member 590 is a separate component from the magnetic impeller 570 and may be secured (detachably or permanently) to the central area of the top (or front) of the magnetic impeller 570. The impeller axial alignment member 590 is preferably made or manufactured of a metal or a hard material, such as, but not limited to, steel, a hard plastic, any material(s) known to one of ordinary skill in the art, and any combination thereof.

The heat sink 600 reduces heat generated from the friction-reducing members 550,560 during operation. As shown in FIG. 12, the heat sink 600 has a first side or surface 602, a second side or surface 604, and a cavity or recess 631. The heat sink 600 is dimensioned and configured for receiving the second, friction-reducing member 560, and for being secured with the cavity or recess 531 of the back cover 520 of the jet assembly housing 510. As a non-limiting example, the cavity or recess 631 has a hexagonal configuration. The heat sink 600 is preferably made or manufactured of a metal material, such as, but not limited to, steel, any metal material (s) known to one of ordinary skill in the art, and any combination thereof.

When the front cover 540 of the jet assembly housing 510 is secured to the back cover 520, it is preferred in a non-limiting example that the vertical distance from a highest point of the impeller arm members 578 to the lowest inlet aperture 535 on the inner surface 541 of the front cover 540 is less than or equal to about half of an inch.

It is preferred that the respective bases or back covers 120,520, caps or front covers 140,540, magnetic impellers 170,570, first, friction-reducing members 150,550, and second, friction-reducing member 160,560 are substantially similar to or exactly the same as one another.

Referring to FIGS. 10-11 and 21-26 and in a second aspect, the present invention is further directed to a magnetic coupling-type fluid pump 700,800 that comprises a jet assembly 100,500 (described above) and a motor assembly 200, and that dispenses or displaces fluid to a work environment or a setting SET, such as, but not limited, to a foot spa, a spa, a jacuzzi, a bathtub, or a swimming pool.

The fluid pump 700,800 may further comprise a mounting housing member or coupling device 250.

Figure 24:
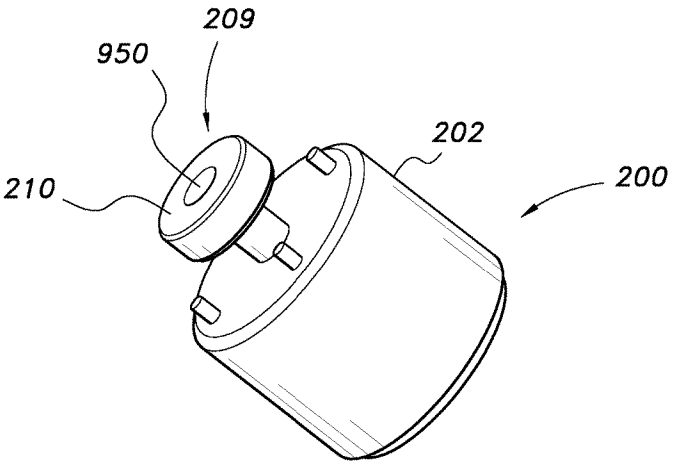
FIG. 24 is a perspective view of a motor assembly according to the present invention, showing a driven magnetic disc assembly being secured to a motor.

As a non-limiting example and as best shown in FIG. 24, the motor assembly 200 includes a motor 202; a driven magnetic disc assembly 209 having a driven magnetic disc 210; and a motor shaft member 950 that is coupled or secured to the driven magnetic disc 210. The mounting housing member 250 preferably enclose all or a substantial portion of the driven magnetic disc 210, and help to keep fluids and/or substances or products away from the motor 202 and driven magnetic disc 210 as much as possible so that contamination and/or damage is reduced or prevented. The driven magnetic disc 210 is formed, constructed, made or manufactured of magnetic material and/or is magnetized.

Furthermore, the motor assembly 200 may further include an air channel (not shown), or air channel member (not shown). In that regard, the air channel includes an inlet (not shown) and outlet (not shown). The air channel, in part, enables the jet assembly 100,500 to produce a jet stream of fluid that includes an air mixture.

Figure 25:
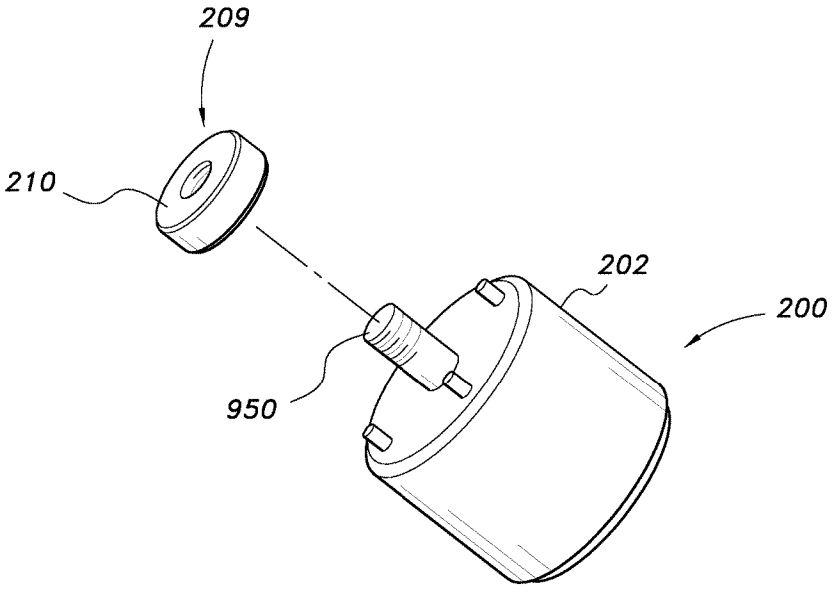
FIG. 25 is an exploded, perspective view of the motor assembly of FIG. 24.

As a non-limiting example and as best shown in FIGS. 24 and 25, the motor 202 may be any motor known to one of ordinary skill in the art that provides energy to the driven magnetic disc assembly 209 and the motor shaft member 950 for rotating the magnetic impeller 170,570.

As a non-limiting example and as best shown in FIGS. 24 and 25, the driven magnetic disc 210 is a one-layer, magnetic disc. The one-layer, magnetic disc 210 is preferred over the two-layer, magnetic disc (not shown) when dealing with manufacturing costs and when dealing with heat generated by the motor and vibrations generated from the magnetic coupling when in use or operation. The two-layer, magnetic disc (not shown) may be comprised of a magnetic disc (an upper, thicker layer) and a holder disc (a lower, thinner layer) that are secured to one another by glue or any other means or method known to one of ordinary skill in the art. The two-layer, magnetic disc (not shown) is secured or mounted to the tip of a motor shaft via the holder disc and motor shaft securing screw.

Figure 26:
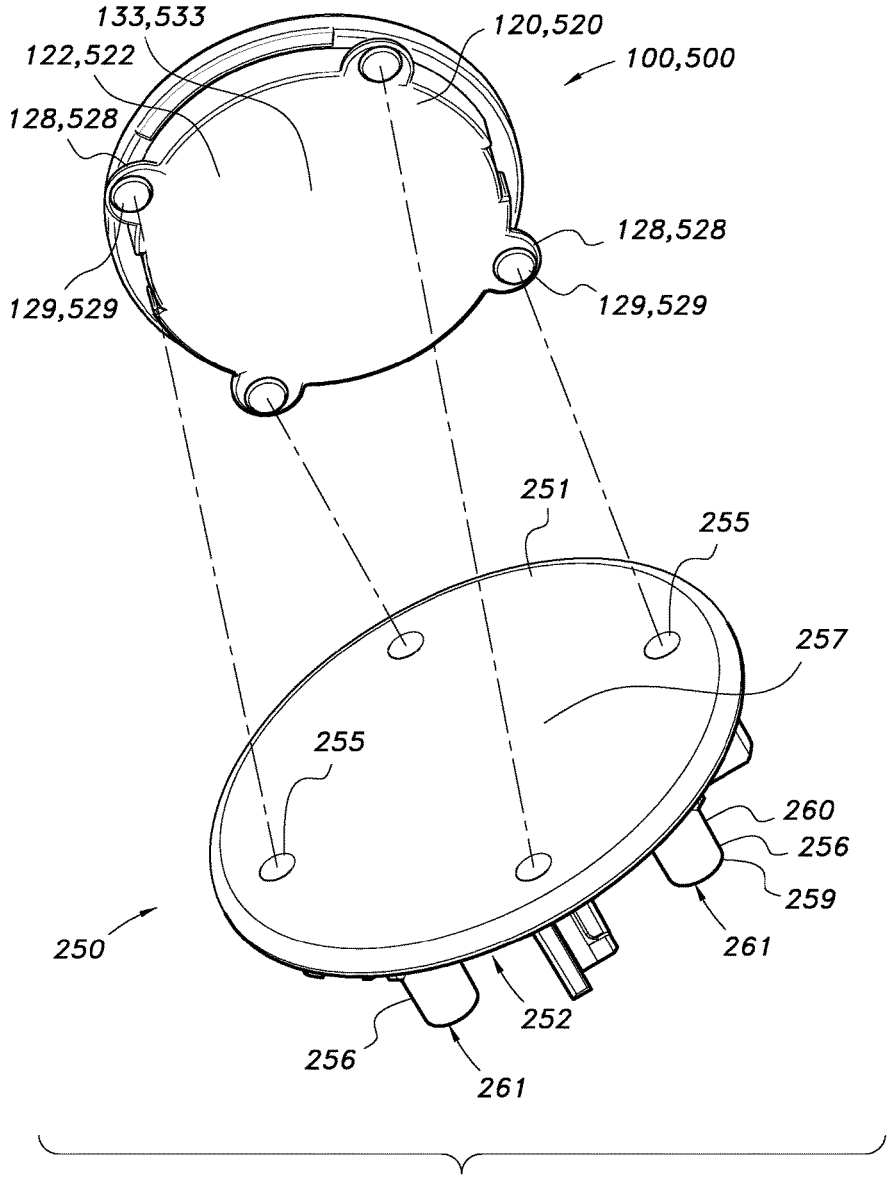
FIG. 26 is an exploded, perspective view of a jet assembly housing and a mounting housing member or coupling device according to the present invention.

As best shown in FIG. 26, the mounting housing member 250 helps to secure, attach or couple the jet assembly 100,500 and motor assembly 200 together, or at least in proximity of one another, such that the jet assembly 100,500 and motor assembly 200 are in operative communication with one another. The mounting housing member 250 includes a front (or top) side 251, a rear (or bottom) side 252, a plurality of engagement holes or ports 255, a plurality of mounting legs 256 extending rearwardly (or downwardly) from the rear (or bottom) side 252, and at least one wing nut 258. Preferably, the front (or top) side 251 is generally flat or has a generally flat, centrally-located section 257 that allows for a liner (not shown) to be positioned behind (or below) the base or back cover 120,520 of the jet assembly housing 110,510 and in front of (or above) the front or top side 251 of the mounting housing member 250 and motor assembly 200, as shown in FIG. 25. Each of the plurality of engagement holes or ports 255 is dimensioned and configured for receiving the corresponding knob 129,529 that extends rearwardly or downwardly from the corresponding feet extension 128,528 of the base or back cover 120,520 of the jet assembly housing 110,510. The securement, attachment or engagement of the knobs 129,529 of the plurality of feet extensions 128,528 to or inside the plurality of engagement holes or ports 255 of the mounting housing member 250 prevents the rotation of the base or back cover 120,520 and cap or front cover 140,540 of the jet assembly housing 110,510 when the fluid pump 700,800 is in operation, and thus form a jet assembly rotation locking mechanism. Each of the plurality of mounting legs 256 has a first end 259, a second end 260, and a hollow channel 261 extending from the first end 259 toward the second end 260. Each hollow channel 261 is dimensioned and configured for receiving a corresponding screw (not shown) of a plurality of screws when the motor assembly 200 is to be secured to the mounting housing member 250. Preferably, the wing nut 258 rotates to extend out to provide a lock for the securement or installation of the mounting housing member 250 and motor assembly 200 to one another. The plurality of screws and wing nuts 258 secure or attach the mounting housing member 250 and motor assembly 200 to one another when the user screws or tightens the screws into the hollow channel 261 of the mounting legs 256 and rotates the wing nut 258. The tightening of the the screws into the hollow channel 261 of the mounting legs 256 and rotation of the wing nut 258 causes pressure to be applied to the gasket or seal 265 such that a strong seal will form between the gasket or seal 265 and contact surface of the setting SET. The mounting housing member 250 may be made or manufactured of plastic, hard plastic, and/or any other suitable material known to one of ordinary skill in the art. Preferably, the mounting housing member 250 is made or manufactured of a plastic material to allow for magnetic field penetration from the motor assembly 200, without any, or with minimal, magnetic field loss. This allows for a magnet or magnets of smaller size, in comparison to a magnet or magnets needed when the mounting housing member 250 is made or manufactured of a non-plastic material, to be used, and, thus, reducing cost for magnets.

As an alternative to, or in addition to, the combination of the knobs 129,529 and engagement holes or ports 255 in forming a jet assembly rotation locking mechanism, at least one nipple (not shown), preferably a plurality of nipples, may be positioned at, or secured or attached to, predetermined locations on the front (or top) side 251 of the mounting housing member 250 such that they form, or help form when combined with the knobs 129,529 and engagement holes or ports 255, a jet assembly rotation locking mechanism.

As shown in FIGS. 11 and 22, the gasket or seal 265, preferably a ring-shaped or ring-type gasket, acts or serves as a fluid or water seal to prevent fluid or water from getting past the contact surface of the setting SET and making contact with the motor assembly 200 during use of the pump 700,800. The gasket 265 is secured to and positioned below (or behind) and adjacent to the rear or bottom side 252 of the mounting housing member 250 and above (or in front of) and adjacent to the contact surface of the setting SET. Preferably, the gasket 265 is made or manufactured of rubber or a rubber-like material.

In a third aspect, the present invention is directed to a method for displacing or dispensing a fluid to a work environment or a setting SET using the jet assembly 100,500 comprising at least one friction-reducing member 150,160, 550,560 (non-limiting examples). To avoid being redundant with the above description of the components and/or limitations described above for the jet assembly 100,500 and/or fluid pumps 700,800, the steps of the method of the present invention include necessary components and/or limitations (described in the preferred method below) related to the jet assembly 100,500 and/or fluid pumps 700,800, and may also include other components and/or limitations (not described in the preferred method below, but described above for the jet assembly 100,500 and/or fluid pumps 700,800).

Preferably, the method comprises the steps of:

providing a jet assembly housing 110,510 that includes a base or back cover 120,520, a cap or front cover 140,540, an impeller-receiving chamber 132,532, a plurality of inlet apertures 135,535, and a plurality of outlet apertures 136, 536;

providing a magnetic impeller that has an outer diameter and a "disc-like" configuration or shape, and includes a front side 172,572, a rear side 174,574, a sidewall 176,576, a circular array of arm members 178,578 positioned on the front side 172,572, and a cavity 179,579, preferably a centrally-disposed or a centrally-located cavity 179,579, dimensioned and configured for receiving the first, friction-reducing member 150,550, wherein the centrally-disposed cavity 179,579 preferably extends from the front side 172, 572 through to the rear side 174,574, and wherein the magnetic impeller 170, 570 is dimensioned and configured to rotate within the jet assembly housing 110,510 (when the back cover 120,520 and front cover 140,540 are secured to one another), within the impeller-receiving chamber 132, 532;

securing at least one friction-reducing member 150,160, 550,560 between the rear side 174,574 of the magnetic impeller 170,570 and the inner surface 121,521 of the base or back cover 520 of the jet assembly housing 110,510 such that the at least one friction-reducing member 150,160,550, 560 will reduce friction of the contact made by the rear side 174,574 of the magnetic impeller 170,570 against the inner surface 121,521 of the base or back cover 520 as the magnetic impeller 170,570 rotates within the jet assembly housing 110,510 during operation or use;

causing rotation of the impeller 170,570 positioned within the impeller-receiving chamber 132,532 defined by the jet assembly housing 110,510 of the jet assembly 100,500;

receiving the fluid through at least one input aperture 135,535 disposed about the jet assembly housing 110,510 of the jet assembly 100,500;

disturbing the fluid with the rotating impeller 170,570; and outputting the fluid through at least one output aperture 135,535 disposed about the jet assembly housing 110,510 of the jet assembly 100,500.

Additionally, the method above may further include:

wherein the jet assembly 100 may also include an impeller axial alignment member 190,590, a vibration noise-reducing member 195, and/or a heat sink 600 as positioned, described and shown above in FIGS. 1-25.

Furthermore, the method above may further include:

wherein the jet assembly 100,500 is adapted for being secured to a motor assembly 200 to form a fluid pump 700,800, such as a magnetic coupling-type pump 700,800 and the like, and wherein the motor assembly 200 includes a motor 202; a driven magnetic disc assembly 209 having a driven magnetic disc 210; and a motor shaft member 950 that is coupled or secured to the driven magnetic disc 210.

It is to be understood that the present invention is not limited to the embodiments and non-limiting examples described above or as shown in the attached figures, but encompasses any and all embodiments within the spirit of the invention.

What is claimed is:

1. A jet assembly of a magnetic coupling-type pump used for dispensing a fluid to an environment in manicure and pedicure industries, said jet assembly comprising:

a jet assembly housing comprising an outer surface, a back cover, a front cover, an impeller-receiving chamber, at least one inlet aperture, and at least one outlet aperture, wherein said back cover comprises an inner surface and an outer surface, wherein said front cover comprises an inner surface and an outer surface, wherein said impeller-receiving chamber is defined by said back cover and said front cover when said back cover and said front cover are secured to one another, wherein said at least one inlet aperture has an outer diameter, wherein said at least one outlet aperture is formed on said outer surface of said jet assembly housing, and wherein said outer surface of said jet assembly housing results from said outer surface of said front cover combining with said outer surface of said back cover when said back cover and said front cover are secured to one another;

said magnetic impeller comprising a front side, a rear side, a sidewall, an outer diameter, and at least one impeller arm member;

a mounting housing member comprising a top surface, a bottom surface, and a shoulder dimensioned and configured to mount to a wall of a basin in the manicure and pedicure industries, wherein said jet assembly is magnetically coupled to said top surface of said mounting housing member; and a pair of friction-reducing members, wherein a first friction-reducing member of said pair of friction-reducing members is secured to said inner surface of said back cover of said jet assembly housing, and wherein a second friction-reducing member of said pair of friction-reducing members is positioned between said rear side of said magnetic impeller and said first friction-reducing member.

2. The jet assembly according to claim 1, wherein said back cover further comprises at least one engagement member, and wherein said front cover further comprises at least one engagement member adapted for engaging with said at least one engagement member of said back cover such that said back cover and said front cover are secured with one another during operation.

3. The jet assembly according to claim 1, wherein said back cover further comprises at least one feet extension that extends away from said outer surface and that is adapted for engaging with said mounting housing member.

4. The jet assembly according to claim 1, wherein said outer surface of said back cover comprises a generally flat, centrally-located section.

5. The jet assembly according to claim 1, wherein said at least one impeller arm member of said magnetic impeller is a plurality of impeller arm members.

6. The jet assembly according to claim 1, wherein at least one of said first friction-reducing member and said second friction-reducing member is manufactured of a hard material selected from the group consisting of ceramic, carbon, steel, and any combination thereof.

7. The jet assembly according to claim 1, further comprising an impeller axial alignment member disposed about and in communication with said magnetic impeller such that said impeller axial alignment member helps initial alignment of said magnetic impeller within said impeller-receiving chamber.

8. The jet assembly according to claim 7, wherein said impeller axial alignment member comprises a first end, a second end, and a body extending between said first and second ends of said impeller axial alignment member, and wherein said impeller axial alignment member extends rearwardly from said inner surface of said front cover toward said magnetic impeller and said inner surface of said back cover when said back cover and said front cover are secured with one another during operation.

9. The jet assembly according to claim 7, wherein said impeller axial alignment member extends forwardly from said front side of said impeller toward said inner surface of said front cover when said back cover and said front cover are secured with one another during operation.

10. The jet assembly according to claim 7, further comprising a vibration noise-reducing member that reduces vibration noise produced by rotation of said magnetic impeller during operation.

11. The jet assembly according to claim 7, further comprising a heat sink positioned at said inner surface of said back cover.

12. The jet assembly according to claim 1, wherein said outer diameter of said at least one inlet aperture is equal to or smaller than said outer diameter of said magnetic impeller.

13. The jet assembly according to claim 1, wherein, when said front cover and said back cover are secured to one another, a vertical distance from a highest point of said at least one impeller arm member to a lowest inlet aperture of said at least one inlet aperture on said inner surface of said front cover is less than or equal to about an inch.

14. The jet assembly according to claim 1, wherein said at least one inlet aperture is located at about center of said front cover.

15. The jet assembly according to claim 1, wherein said at least one outlet aperture is spaced radially from said at least one inlet aperture.

16. A magnetic coupling-type fluid pump used for dispensing a fluid to an environment in manicure and pedicure industries, said fluid pump comprising:

a jet assembly comprising a jet assembly housing, a magnetic impeller, and a pair of friction-reducing members, wherein said jet assembly housing comprises a back cover, a front cover, an impeller-receiving chamber, at least one inlet aperture, and at least one outlet aperture, wherein said impeller-receiving chamber is defined by said back cover and said front cover when said back cover and said front cover are secured to one another, wherein said at least one inlet aperture has an outer diameter, wherein said magnetic impeller comprises a front side, a rear side, a sidewall, an outer diameter, and at least one impeller arm member, wherein a first friction-reducing member of said pair of friction-reducing members is secured to said inner surface of said back cover of said jet assembly housing, and wherein a second friction-reducing member of said pair of friction-reducing members is positioned between said rear side of said magnetic impeller and said first friction-reducing member; and a motor assembly comprising a motor, a driven magnetic disc assembly, and a motor shaft member; and a mounting housing member comprising a too surface, a bottom surface, and a shoulder dimensioned and configured to mount to a wall of a basin in the manicure and pedicure industries, wherein said jet assembly is magnetically coupled to said top surface of said mounting housing member.

17. The fluid pump according to claim 16, wherein said back cover further comprises at least one engagement member, and wherein said front cover further comprises at least one engagement member adapted for engaging with said at least one engagement member of said back cover such that said back cover and said front cover are secured with one another during operation.

18. The fluid pump according to claim 16, wherein said back cover further comprises at least one feet extension that extends away from said outer surface and that is adapted for engaging with said mounting housing member.

19. The fluid pump according to claim 16, wherein said outer surface of said back cover comprises a generally flat, centrally-located section.

20. The fluid pump according to claim 16, wherein said at least one impeller arm member of said magnetic impeller is a plurality of impeller arm members.

21. The fluid pump according to claim 16, wherein at least one of said first friction-reducing member and said second friction-reducing member is manufactured of a hard material selected from the group consisting of ceramic, carbon, steel, and any combination thereof.

22. The fluid pump according to claim 16, further comprising an impeller axial alignment member disposed about and in communication with said magnetic impeller such that said impeller axial alignment member helps initial alignment of said magnetic impeller within said impeller-receiving chamber.

23. The fluid pump according to claim 22, wherein said impeller axial alignment member comprises a first end, a second end, and a body extending between said first and second ends of said impeller axial alignment member, and wherein said impeller axial alignment member extends rearwardly from said inner surface of said front cover toward said magnetic impeller and said inner surface of said back cover when said back cover and said front cover are secured with one another during operation.

24. The fluid pump according to claim 22, wherein said impeller axial alignment member extends forwardly from said front side of said impeller toward said inner surface of said front cover when said back cover and said front cover are secured with one another during operation.

25. The fluid pump according to claim 22, further comprising a vibration noise-reducing member that reduces vibration noise produced by rotation of said magnetic impeller during operation.

26. The fluid pump according to claim 16, wherein said outer diameter of said at least one inlet aperture is equal to or smaller than said outer diameter of said magnetic impeller.

27. The fluid pump according to claim 16, wherein, when said front cover and said back cover are secured to one another, a vertical distance from a highest point of said at least one impeller arm member to a lowest inlet aperture of said at least one inlet aperture on said inner surface of said front cover is less than or equal to about an inch.

28. The fluid pump according to claim 16, wherein said mounting housing member further comprises at least one mounting leg.

29. The fluid pump according to claim 28, wherein said at least one mounting leg is dimensioned and configured for receiving a wing nut.

30. A method for dispensing a fluid to an environment in manicure and pedicure industries using a jet assembly of a magnetic coupling-type pump, the method comprising the steps of:

providing a jet assembly housing comprising an outer surface, a back cover, a front cover, an impeller-receiving chamber, at least one inlet aperture, and at least one outlet aperture, wherein said back cover comprises an inner surface, and an outer surface, wherein said impeller-receiving chamber is defined by said back cover and said front cover when said back cover and said front cover are secured to one another;

providing a magnetic impeller comprising a front side, a rear side, a sidewall, an outer diameter, and at least one impeller arm member;

wherein, during operation, said magnetic impeller is positioned within said impeller-receiving chamber and is dimensioned and configured to rotate within said impeller-receiving chamber whereby rotation of said magnetic impeller causes the fluid to flow through said at least one inlet aperture and enter into said impeller-receiving chamber of said jet assembly housing and causes the stream of fluid to be dispensed through each of said at least one outlet aperture to the environment in the manicure and pedicure industries;

providing a mounting housing member comprising a top surface, a bottom surface, and a shoulder dimensioned and configured to mount to a wall of a basin in the manicure and pedicure industries, wherein said let assembly is magnetically coupled to said top surface of said mounting housing member; and securing a pair of friction-reducing members between said magnetic impeller and said inner surface of said back cover of said jet assembly housing such that said pair friction-reducing members will reduce friction of contact made by said magnetic impeller against said inner surface of said back cover as said magnetic impeller rotates within said jet assembly housing during operation;

causing rotation of said magnetic impeller positioned within said impeller-receiving chamber;

receiving the fluid through said at least one inlet aperture;

disturbing the fluid with said magnetic impeller that is rotating; and dispensing the stream of fluid through each of said at least one outlet aperture and to the environment in the manicure and pedicure industries.

* * * * *